US008448677B2

(12) United States Patent
Ficai et al.

(10) Patent No.: US 8,448,677 B2
(45) Date of Patent: May 28, 2013

(54) APPARATUS AND METHOD FOR REFILLING A REFILLABLE CONTAINER

(75) Inventors: Pietrandrea Gabriele Ficai, Parma (IT); Pierre Somers, Montreal (CA)

(73) Assignee: Surface Technologies IP AG, Rotkreuz (CH)

( * ) Notice: Subject to any disclaimer, the term of this patent is extended or adjusted under 35 U.S.C. 154(b) by 755 days.

(21) Appl. No.: 12/456,005

(22) Filed: Jun. 9, 2009

(65) Prior Publication Data

US 2010/0307634 A1 Dec. 9, 2010

(51) Int. Cl.
*B67C 3/02* (2006.01)
*B65D 1/06* (2006.01)

(52) U.S. Cl.
CPC ..... *B65D 1/06* (2013.01)
USPC ..... 141/113; 141/3; 141/20; 141/104; 141/105

(58) Field of Classification Search
USPC ..... 141/3, 20, 100–107, 113
See application file for complete search history.

(56) References Cited

U.S. PATENT DOCUMENTS

| | | | | |
|---|---|---|---|---|
| 2,613,023 | A * | 10/1952 | Reich | 53/432 |
| 3,298,383 | A * | 1/1967 | Cooper | 137/3 |
| 3,502,118 | A * | 3/1970 | Assalit | 141/20 |
| 4,688,946 | A * | 8/1987 | Latif et al. | 366/162.1 |
| 4,750,532 | A * | 6/1988 | Grothoff | 141/27 |
| 4,921,020 | A | 5/1990 | Pamper | |
| 5,343,904 | A | 9/1994 | Kaeser | |
| 5,645,113 | A * | 7/1997 | Humm et al. | 141/3 |
| 5,839,623 | A | 11/1998 | Losenno et al. | |
| 5,992,478 | A * | 11/1999 | Micke et al. | 141/196 |
| 6,116,296 | A * | 9/2000 | Turunen | 141/20 |
| 6,234,221 | B1 | 5/2001 | Clark, II | |
| 6,269,837 | B1 | 8/2001 | Arent et al. | |
| 6,520,220 | B2 | 2/2003 | Durkin et al. | |
| 6,607,012 | B2 | 8/2003 | Yquel | |
| 6,691,746 | B2 * | 2/2004 | Brennan et al. | 141/3 |
| 6,883,564 | B2 | 4/2005 | Risch et al. | |

FOREIGN PATENT DOCUMENTS

GB 1161669 8/1969

OTHER PUBLICATIONS

ISR/Written Opinion, Aug. 9, 2010, PCT.

* cited by examiner

*Primary Examiner* — Timothy L Maust
(74) *Attorney, Agent, or Firm* — Paine Hamblen, LLP

(57) ABSTRACT

A refilling apparatus for a refillable container and associated methodology is described and wherein the apparatus includes a refillable dispensing container; a source of pressurized propellant for delivery to the refillable dispensing container; a valve coupled in fluid flowing relation relative to the source of pressurized propellant; a source of a liquid to be dispensed by the refillable container and which is coupled in fluid flowing relation relative to the valve, and a pressurized vessel positioned downstream relative to both the sources of the liquid to be dispensed, and the pressurized propellant, as well as the valve, and which encloses a volume of the liquid to be dispensed to refill a depleted refillable dispensing container when the refillable dispensing container engages the valve.

23 Claims, 8 Drawing Sheets

APPARATUS AND METHOD FOR REFILLING A REFILLABLE CONTAINER

TECHNICAL FIELD

The present invention relates to a refilling apparatus for a refillable container, and a method for refilling a refillable container, and more specifically to an apparatus, and method whereby a refillable dispensing container may be reliably, and conveniently refilled with a source of pressurized propellant, and a liquid to be dispensed in a manner not possible heretofore.

BACKGROUND OF THE INVENTION

Those skilled in the art have long recognized that various liquids for assorted industrial, and other applications can be conveniently dispensed as an aerosol by a hand-held dispensing container and by means of a pressurized propellant. Heretofore, the problem of aerosols, and gas propellants employed in such disposable spray, and aerosol cans has been related to the replacement of the previously environmentally harmful propellants in favor of relatively benign propellants such as compressed air. Further, various municipalities have taken steps to prohibit the use of disposable aerosol, and similar containers because of the propensities for these disposable aerosol containers to retain small amounts of the liquids to be dispensed, and which might be harmful or environmentally toxic if, and when, released to the water table or ambient atmosphere from a sanitary landfill or the like. While various prior art teachings have taught the use of refillable dispensing containers, which may be refilled with both a pressurized propellant, and a liquid to be dispensed, such devices and the associated dispensers have been unduly cumbersome, and complex in their construction and have often not reliably refilled or repressurized the refillable dispensing container. Additionally, many such prior art devices have not been widely embraced by various industry segments.

A refilling apparatus for a refillable container, and a method for refilling a refillable container which avoids the shortcomings attendant with the prior art practices and devices utilized heretofore is the subject matter of the present application.

SUMMARY OF THE INVENTION

A first aspect of the present invention relates to a refilling apparatus for a refillable container, and which includes a refillable dispensing container for receiving, and then dispensing, a liquid by means of a pressurized propellant which is delivered to, and enclosed within, the refillable dispensing container; a source of pressurized propellant for delivery to the refillable dispensing container; a valve coupled in fluid flowing relation relative to the source of pressurized propellant, and which further when engaged by the refillable dispensing container facilitates the delivery of the source of pressurized propellant; a source of a liquid to be dispensed by the refillable container, and which is coupled in fluid flowing relation relative the valve, and wherein the valve further facilitates the delivery of the source of the liquid, and the propellant into the refillable dispensing container; and a pressurized vessel positioned in downstream fluid flowing relation relative to both the sources of the liquid to be dispensed, and the pressurized propellant, as well as the valve, and which further encloses a volume of the liquid to be dispensed, and the propellant, to refill a depleted refillable dispensing container when the refillable dispensing container engages the valve.

Another aspect of the present invention relates to a refilling apparatus for a refillable container, and which includes a refillable container having a main body with a dispensing end, and an opposite bottom surface, and which further defines an internal cavity having a given volume; a first portion of a filling valve mounted on the bottom surface of the refillable container; a dispensing valve mounted on the dispensing end of the refillable container; a first filling station for matingly receiving the bottom surface of the refillable container, and wherein a second portion of a filling valve is mounted in the first filling station, and is configured to matingly couple with the first portion of the filling valve which is mounted on the refillable container; a source of a pressurized propellant for selective delivery to the internal cavity of the refillable container; a source of a liquid to be dispensed by the refillable container, and which is delivered to the internal cavity of the refillable container, and wherein the sources of pressurized propellant, and the liquid to be dispensed are delivered into the internal cavity of the refillable container when the first, and second portions of the filling valves are coupled together in fluid flowing relation; a supply tank for receiving the source of the liquid to be dispensed, a float valve mounted within the supply tank, and which is coupled in fluid flowing relation relative to the source of the liquid to be dispensed, and wherein the float valve selectively delivers the liquid to be dispensed into the supply tank so as to maintain the liquid to be dispensed at a given liquid level; a one-way check valve mounted in downstream fluid flowing relation relative to the supply tank, and which facilitates the gravitational flow of the liquid to be dispensed out of the supply tank; a pressurized vessel having a given internal volume, and which is positioned in downstream gravity receiving fluid flowing relation relative to the check valve, and wherein the internal volume of the pressurized vessel is less than the internal volume of the refillable container; a manifold coupled to the source of the pressurized propellant; a three-way valve coupled in fluid flowing relation relative to the manifold, and to each of the supply tank, and the pressurized vessel, and wherein the three-way valve is operatively, and forceably engaged by the refillable dispensing container when it is positioned in the first refilling station; a second refilling station located near the first refilling station, and which has a second portion of a filling valve which will releasably couple with the first portion of the refilling valve which is mounted on the bottom of the refillable dispensing container, and wherein the second refilling station is coupled in fluid flowing relation relative to the manifold so as to supply the source of pressurized propellant to the refillable dispensing container when it is located in the second refilling station; a first conduit coupling the three-way valve in fluid flowing relation relative to the pressurized vessel, and wherein the first conduit has an intermediate portion which is located in an elevationally higher location than the liquid level which is maintained in the supply tank by the float valve; a second conduit coupling the pressurized vessel in fluid flowing relation relative to the first portion of the filling valve which is located in the first refilling station; and a third conduit coupling the three-way valve with the supply tank, and wherein the positioning of the refillable dispensing container within the first refilling station causes the first, and second portions of the filling valve to be releasably coupled together, and the three-way valve to be forcibly engaged so as to cause the three-way valve to move from a first operational position to a second operational position which causes the delivery of the source of the pressurized propellant to the pressurized vessel by way of the first conduit, and the propellant and liquid to be dispensed is then delivered from the pressurized vessel to the internal volume of the refillable dispensing container by way of the second conduit; and wherein upon removal of the refillable dispensing container from the first refilling station the three-way valve moves to the first operational position wherein the excessive pressurized propellant passes through the three-way valve, and is received in the supply tank, and returned to the ambient environment, and wherein following removal of the refillable dispensing container the check valve permits the flow of the liquid to be dispensed from the supply tank, and into the pressurized vessel, and wherein the liquid flowing from the supply tank fills the pressurized vessel, and flows into the first conduit to a level which is substantially equal to the height of the liquid level which is maintained by the float valve within the supply tank.

Still further, another aspect of the present invention relates to a method for refilling a refillable container which includes the steps of providing a refillable dispensing container having an internal volume; providing a refilling station that releasably fluidly couples with the refillable dispensing container; providing a source of a pressurized propellant, and coupling the source of the pressurized propellant to the refilling station; providing a source of a liquid to be dispensed by the refillable dispensing container, and coupling the source of the liquid to be dispensed to the refilling station; and delivering a predetermined amount of pressurized propellant, and a volume of liquid to be dispensed to the refillable dispensing container which is less than the internal volume of the refillable container.

Yet still another aspect of the present invention relates to a method for refilling a refillable container which includes the steps of providing a source of pressurized propellant; providing a supply tank enclosing a source of a liquid to be dispensed; providing a refilling station; providing a refillable dispensing container which is configured to mating fluidly couple with the refilling station; providing a three-way valve which has a first, and a second operational position, and locating the three-way valve in the refilling station so that the three-way valve may be forcibly engaged so as move from a first operational position, to a second operational position when the refillable dispensing container is located in the refilling station, and operably engages the three-way valve, and further coupling the three-way valve in fluid flowing relation relative to the source of pressurized propellant, and wherein the three-way valve delivers the source of the propellant to the refillable dispensing container when the three-way valve is located in the second operational position; providing a pressurized vessel which is located in downstream liquid receiving relation relative to the supply tank, and coupling the pressurized vessel in fluid flowing relation relative to the three-way valve; selectively supplying the source of the liquid to be dispensed from the supply tank to the pressurized vessel so as to fill the pressurized vessel with the source of the liquid to be dispensed when the three-way valve is located in the first operational position, and the refillable container is removed from the refilling station; coupling the supply tank in fluid flowing relation relative to the three-way valve; coupling the pressurized vessel in fluid flowing communication with the refilling station; and supplying the source of liquid to be dispensed from the pressurized vessel to the refilling station with the pressurized propellant when the three-way valve is located in the second position.

Another aspect of the present invention relates to a refilling apparatus for a refillable container which includes a refillable dispensing container for receiving and then dispensing a liquid by means of a pressurized propellant which is delivered to and enclosed within the refillable dispensing container; a source of pressurized propellant for delivery to the refillable dispensing container; a first valve coupled in fluid flowing relation relative to the source of pressurized propellant and which further, when engaged by the refillable dispensing container facilitates the delivery of the source of pressurized propellant; a supply tank containing a source of a liquid to be dispensed by the refillable dispensing container and which is coupled in gravity feeding fluid flowing relation relative to the first valve, and wherein the first valve facilitates the delivery of the source of the liquid to be dispensed, and the propellant into the refillable dispensing container; a supply of the source of liquid to be dispensed and which is enclosed within a sealed storage container, and which is coupled in fluid flowing relation relative to the supply tank; a second valve coupled in fluid flowing relation relative to the source of pressurized propellant and with the sealed storage container, and which further, when engaged by the refillable dispensing container facilitates the delivery of the source of pressurized propellant to the sealed storage container enclosing the supply of the liquid to be dispensed so as to facilitate the movement of the liquid enclosed in the sealed storage container to the supply tank; and a pressurized vessel positioned in downstream fluid flowing relation relative to the supply tank to receive the source of fluid to be dispensed and the pressurized propellant as delivered by the first valve, and which further encloses a volume of the liquid to be dispensed and the propellant, to refill a depleted refillable dispensing container when the first refillable dispensing container engages both the first and second valves.

These, and other aspects of the present invention, will be described in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
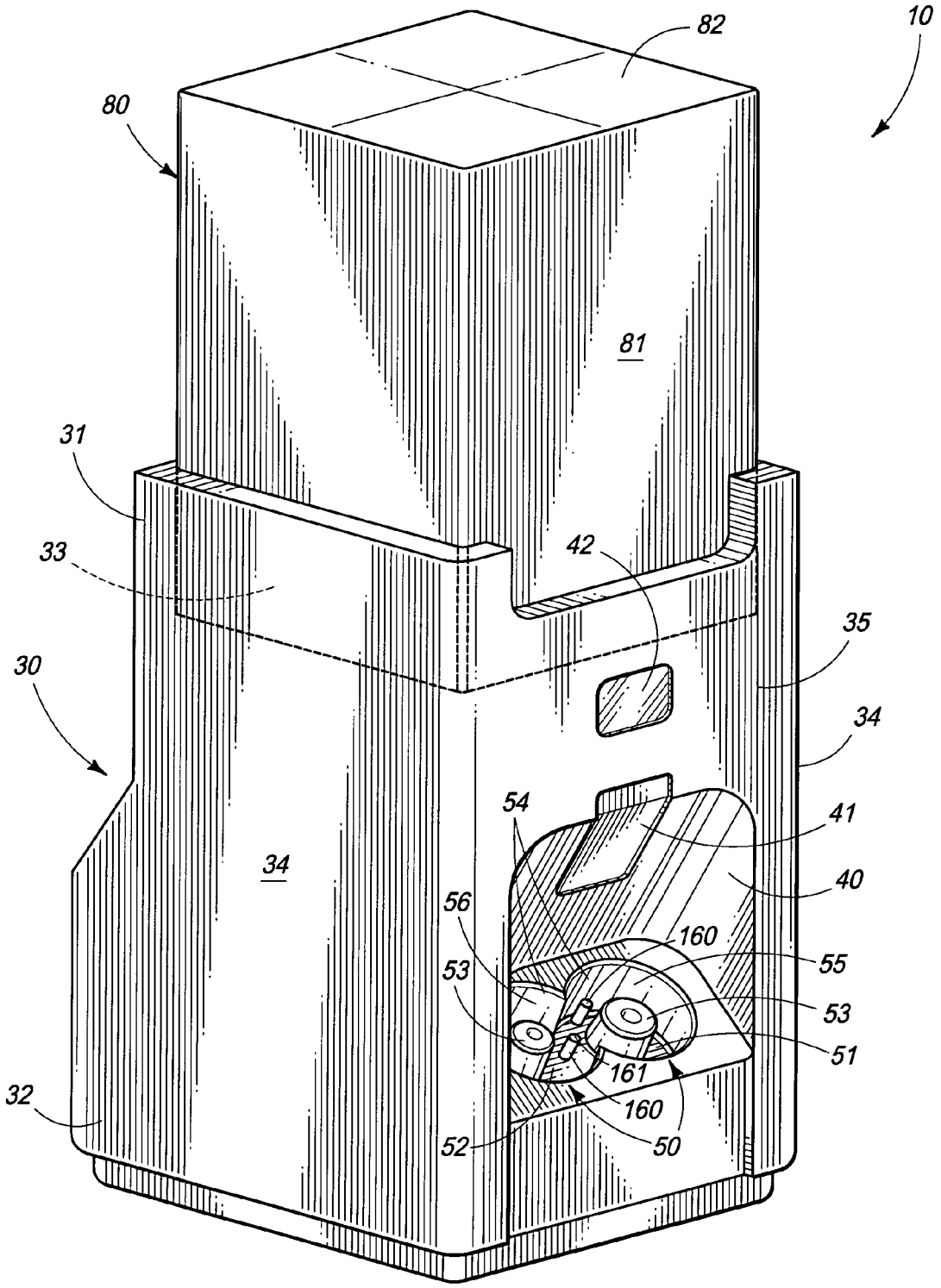
FIG. 1 is a perspective view of a refilling apparatus for a refillable container and which includes the several features of the present invention.
Figure 4:
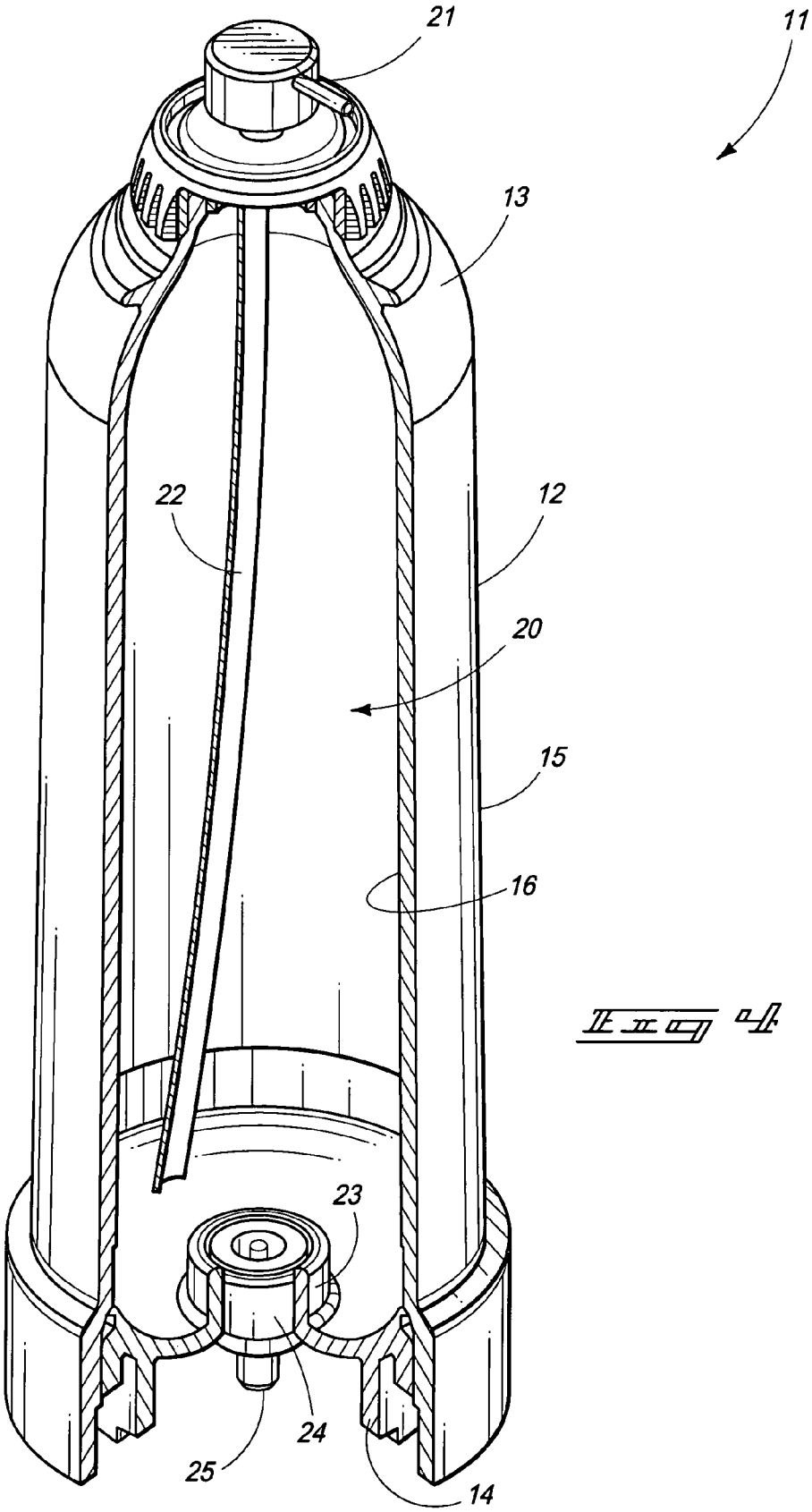
FIG. 4 is a transverse, vertical, sectional view of a refillable container which may be refilled by a refilling apparatus as described in the present application.

The refilling apparatus for a refillable container and methodology thereof, is generally indicated by the numeral 10 in FIG. 1, and following. In this regard, the refilling apparatus for a refillable container 10 is operable to cooperate with, and otherwise recharge or refill a refillable dispensing container which is generally indicated by the numeral 11 in FIG. 4. The refillable dispensing container 11 is rendered operable for receiving, and then dispensing a liquid by means of a pressurized propellant which is delivered to, and enclosed within the refillable dispensing container. The liquid which will be dispensed by the refillable dispensing container as well as the pressurized propellant which is delivered to same will be discussed in greater detail in the paragraphs which follow. The refillable dispensing container 11 as seen in FIG. 4, has a main body 12 which has a first dispensing end 13, and an opposite second or bottom end 14 which is fitted or otherwise secured to the main body 12. Typically, the second or bottom end 14 threadably mates in an appropriate fashion with the main body 12. Still further, the main body 12 has an outside facing surface 15, and an opposite inside facing surface 16 which further defines an internal cavity 20 having a predetermined or given volume. In another possible form of the invention, not shown, the refillable dispensing container could be fabricated from aluminum or the like and extruded as a single piece structure, as opposed to the multiple-piece structure described, above. Fastened on the first or dispensing end 13 is a dispensing valve 21 of conventional design. The dispensing valve is operable to be depressed by the hand of an operator (not shown), and thereby release the enclosed fluid to be dispensed under the force exerted by the enclosed, pressurized propellant to an intended object of interest (not shown). In another possible form of the invention (not shown), this dispensing valve may be threadably coupled to the dispensing container in various ways, including by the use of a knurled nut. Coupled to the dispensing valve 21, and depending downwardly relative thereto, and into the internal cavity 20 is an appropriate feeding tube 22 which is operable to receive the liquid to be dispensed from the internal cavity, and direct it to the dispensing valve 21 under the influence of compressed propellant which is received, and contained within the internal cavity 20. As best seen in FIG. 4, an annularly shaped support member 23 is mounted on the second or bottom end 14, and extends coaxially inwardly relative to the internal cavity 20. The annular support member 23 is operable to receive, support, or otherwise enclose, at least in part, a first portion of a filling valve 24. The first portion of the filling valve 24 has a distal end 25 which is operable to matingly couple in fluid flowing relation relative to a second portion of a filling valve, and which is mounted, in a refilling station which is located on the housing of the refilling apparatus 10 as will be described, hereinafter. While the drawings show the first portion of the filing valve as being a male portion, and the second portion as being a receiving, female portion, it will be appreciated that the male and female portions could be reversed in their respective locations with no substantial change in the operation of the apparatus 10 taking place.

Referring now to FIG. 1, in one form of the invention, the apparatus for refilling a refillable container 10 of the present invention is defined, at least in part, by an exterior housing 30 which has a first or upper end 31, and a second or lower end 32 which rests on a supporting surface such as a counter cabinet, or the like. Still further, formed in the first end 31, is a cavity 33, which is operable to matingly receive, at least in part, a liquid supply cartridge or box containing a bladder (bag-in-a-box) with the desired liquid to be dispensed as will be described in greater detail, hereinafter. Still further, the housing 30 includes opposite sidewalls 34, and a front wall 35. The front wall has a cavity 40 formed therein. Still further, a transparent window 41 is mounted in the front wall 35, and allows an operator to view the liquid level of a supply tank which is located in the housing 30 as will be described hereinafter. Still further, mounted on the front wall 35 is a fluid coupler release button 42, which when depressed by the operator will fluidly uncouple the aforementioned liquid supply cartridge 81 as will be described in greater detail hereinafter. As seen in FIG. 1, a pair of refilling stations 50 are located within the cavity 40 as formed in the front wall 35. The pair of refilling stations include a first refilling station 51, and a second refilling station 52 which is located in predetermined spaced relation relative thereto. Mounted substantially centrally of each of the first, and second refilling stations 51 and 52 is a second portion of a filling valve 53 which is operable to releasably matingly couple with the first portion of the filing valve 24 which is mounted on the bottom end 14 of the refillable dispensing container 11 as seen in FIG. 4. By studying FIG. 1, it will be recognized that the first, and second refilling stations 51, and 52 are defined by a cavity 54 which has a first portion 55, and a second portion 56. The first, and second portions have an inside diametral dimension which is greater than the outside diametral dimension of the refillable dispensing container 11 so that the second or bottom end 14 may be received in either of the first or second portions 55 or 56 of the cavity 54. Because of the arrangement of the first, and second portions of the cavities 55 and 56, it will be recognized that only one refillable dispensing container 11 may be received in the cavity 54 at a time. This effectively prevents an operator of the present apparatus 10 from attempting to simultaneously refill two refillable dispensing containers 11.

Figure 8:
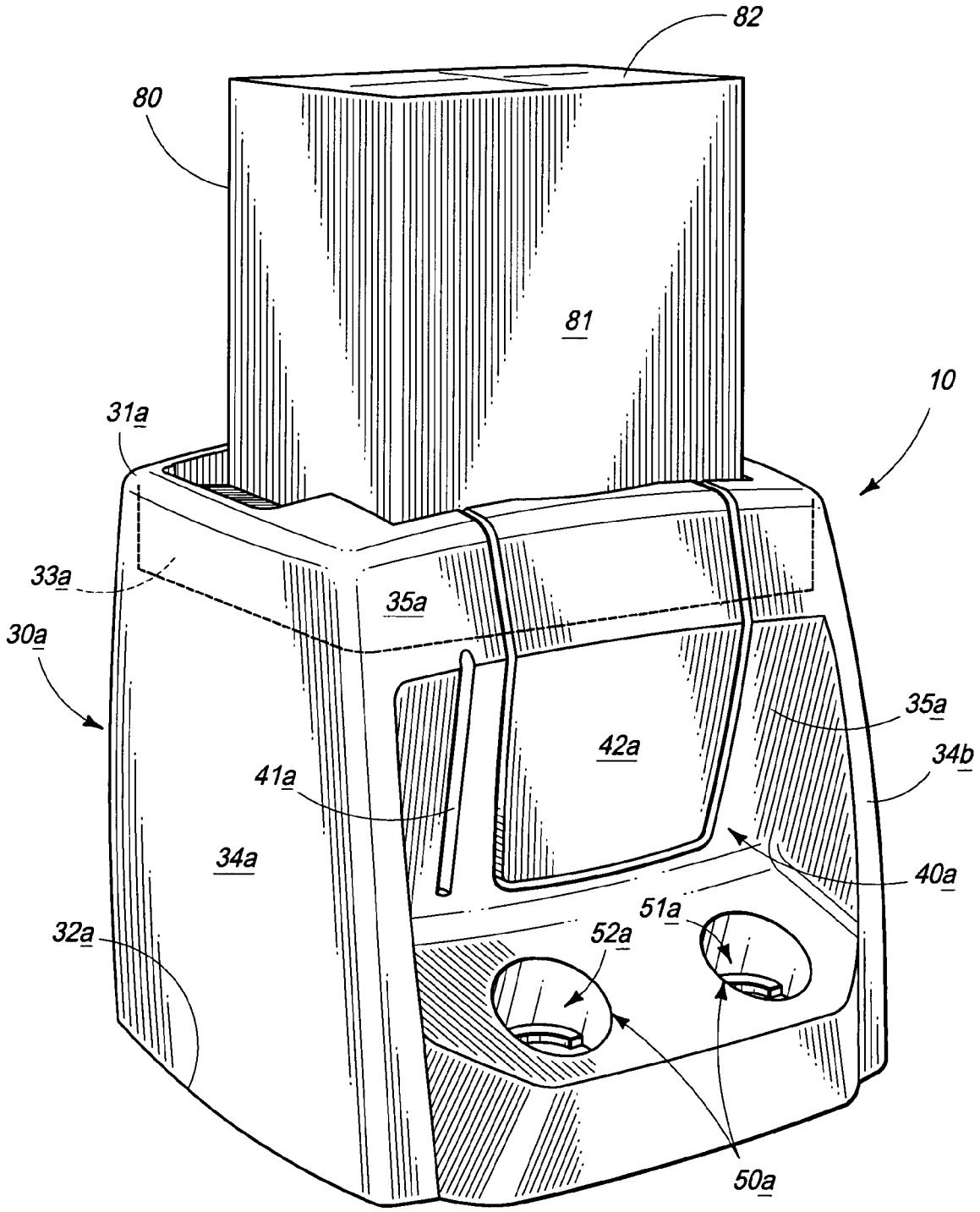
FIG. 8 is a perspective view of a second form of a refilling apparatus for a refillable container and which includes the several features of the present invention.

Referring now to FIG. 8, in a second possible form of the invention 10 for refilling a refillable container 11, it will be seen that the invention includes an exterior housing 30A which has a first, or upper end 31A, and a second, or lower end 32A, which similarly rests on a supporting surface. Again, like the first form of the invention as seen in FIG. 1, the first end 31A defines a cavity 33A which is operable to matingly receive, at least in part, a liquid supply cartridge or box containing a bladder (bag-in-a-box) with the desired liquid to be dispensed as will be described in greater detail, hereinafter. The housing 30A includes opposite sidewalls 34A and 34B. Still further, the housing has a front wall 35A. The front wall has a cavity 40A formed therein. Still further, a portion of a transparent conduit 41A lies along the front wall 35A. This portion of the transparent conduit 41A allows the operator to view the liquid level in a supply tank, which is located in the housing 30A, as will be described hereinafter. Further, the front wall 35A is defined in part by a door 42A which allows an operator to gain access to at least a part of the cavity 33A. As seen in FIG. 8, a pair of refilling stations or pods 50A are located within the cavity 40A as formed in the front wall 35A. The pair of refilling stations or pods 50A are defined by a first refilling station 51A, and a second refilling station 52A which is located in predetermined spaced relation relative thereto. Similar to the first form of the invention as seen in FIG. 1, and discussed above, the first and second refilling stations include the second portion of the filling valve as described and seen in FIG. 1, and which is operable to releasably matingly couple with the first portion of the filling valve which is mounted on the bottom end 14 of the refillable dispensing container 11. As seen in FIG. 8, it will be recognized that the first and second refilling stations 51A and 52A are spaced apart at a given distance so as to permit two refillable dispensing containers 11 to be refilled simultaneously. This is in contrast to that seen in FIG. 1 where the close location of the first and second refilling stations together effectively prohibits the refilling of more than one refillable dispensing container 11 at a time.

Figure 2:
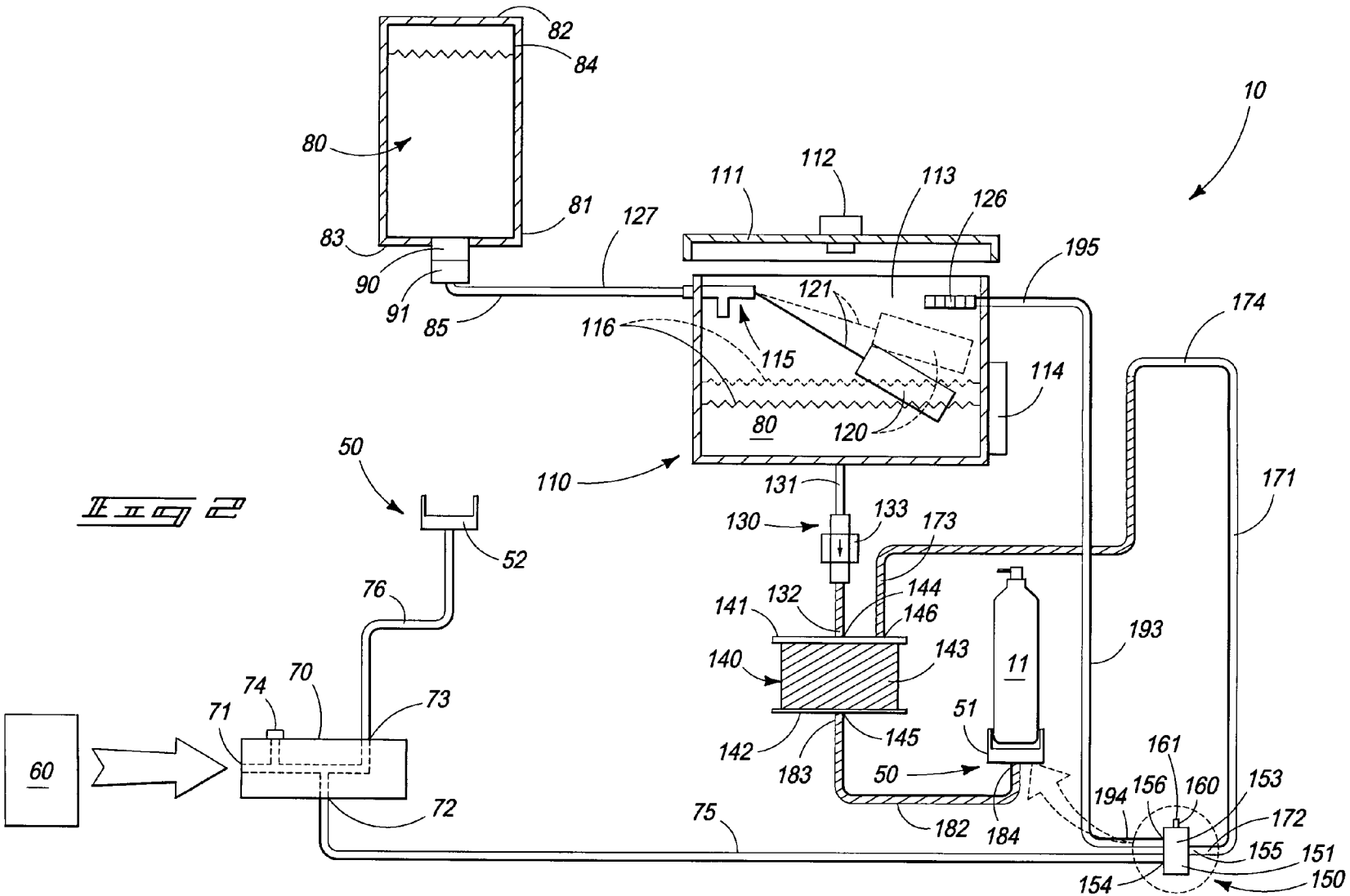
FIG. 2 is a greatly simplified, schematic view, of a first form of a refilling apparatus for a refillable container having the several features of the present invention.
Figure 3:
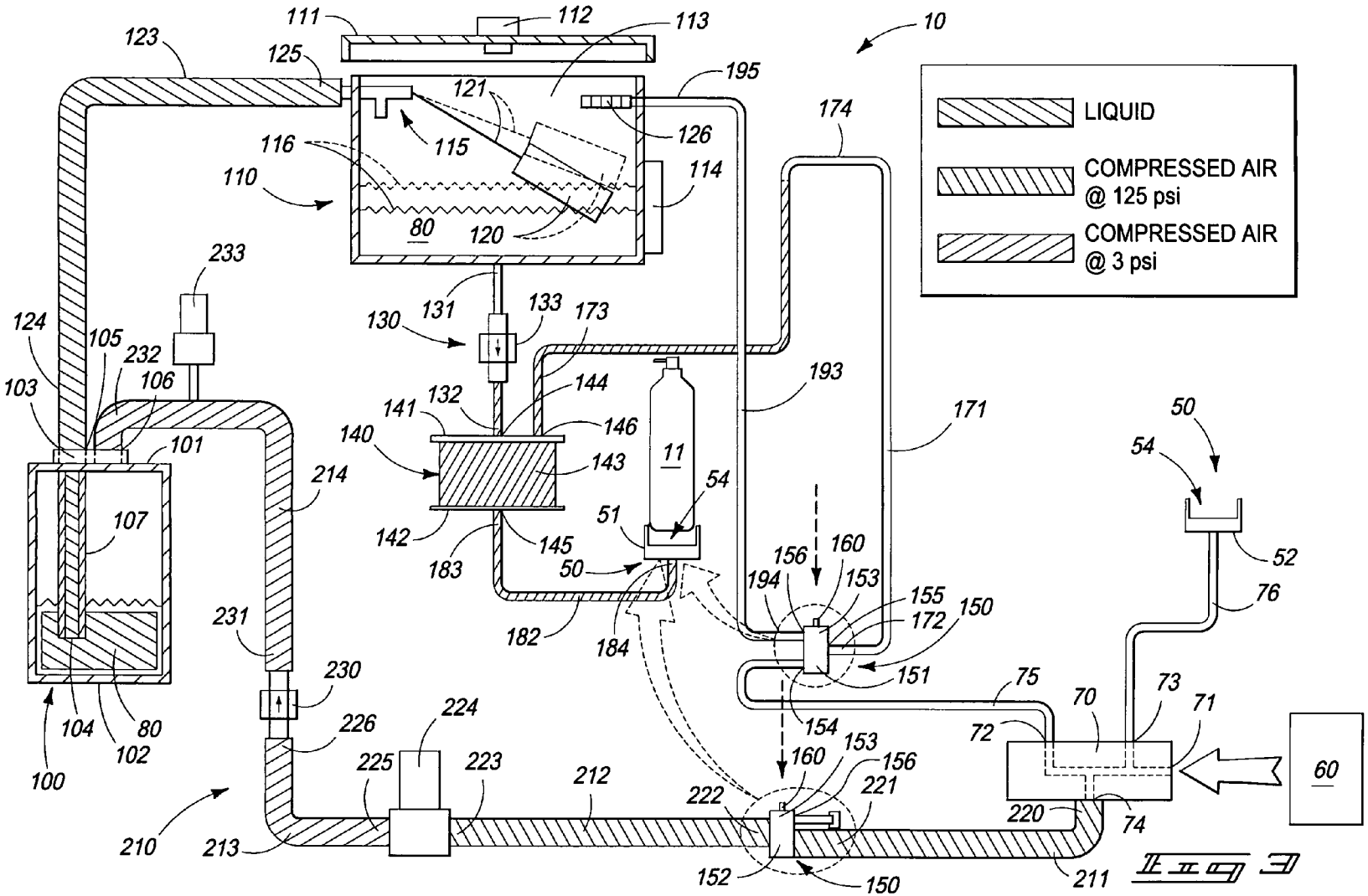
FIG. 3 is a greatly simplified, schematic view, of a second form of a refilling apparatus for a refillable container of the present invention.

As best seen by reference to FIG. 2, the present refilling apparatus, and associated methodology 10 includes a source of pressurized propellant which is generally indicated by the numeral 60, and which is provided for delivery to the refillable dispensing container 11 in the manner defined by the several method steps as will be discussed in greater detail later in this application. The source of pressurized propellant 60 may be provided from conventional sources, (compressor, bottle or the like) and is typically supplied at a pressure of less than about 150 pounds per square inch. The source of pressurized propellant 60 is coupled in fluid flowing relation relative to a manifold which is generally indicated by the numeral 70. The manifold 70 has a first intake port 71, which is coupled in fluid flowing relation to the source of pressurized propellant, and second; third; and fourth exhaust ports 72, 73 and 74, respectively. As seen in FIG. 2, and following, the second exhaust port 72 is coupled in fluid flowing relation relative to a three-way valve as will be described in greater detail hereinafter. Still further, the third exhaust port 73 is coupled in fluid flowing relation relative to the second refilling station 52. Still further, the fourth exhaust port 74 (as seen in FIG. 3 only) is fluidly coupled to a pressurized supply vessel as will be described in greater detail hereinafter. In FIG. 2, the fourth exhaust port is blocked or otherwise capped off. As understood best by FIG. 2, a first propellant supply line 75 is operable to deliver pressurized propellant from the manifold 70, and more specifically, the second exhaust port 72 to the three-way valve as will be discussed in greater detail hereinafter. Further, a second propellant supply line 76 couples the manifold, and more specifically, the third exhaust port 73 with the second refilling station 52, and more specifically, the second portion 53 of the filling valve which is mounted in the second refilling station 52 and which is best seen in FIG. 1.

Figure 6:
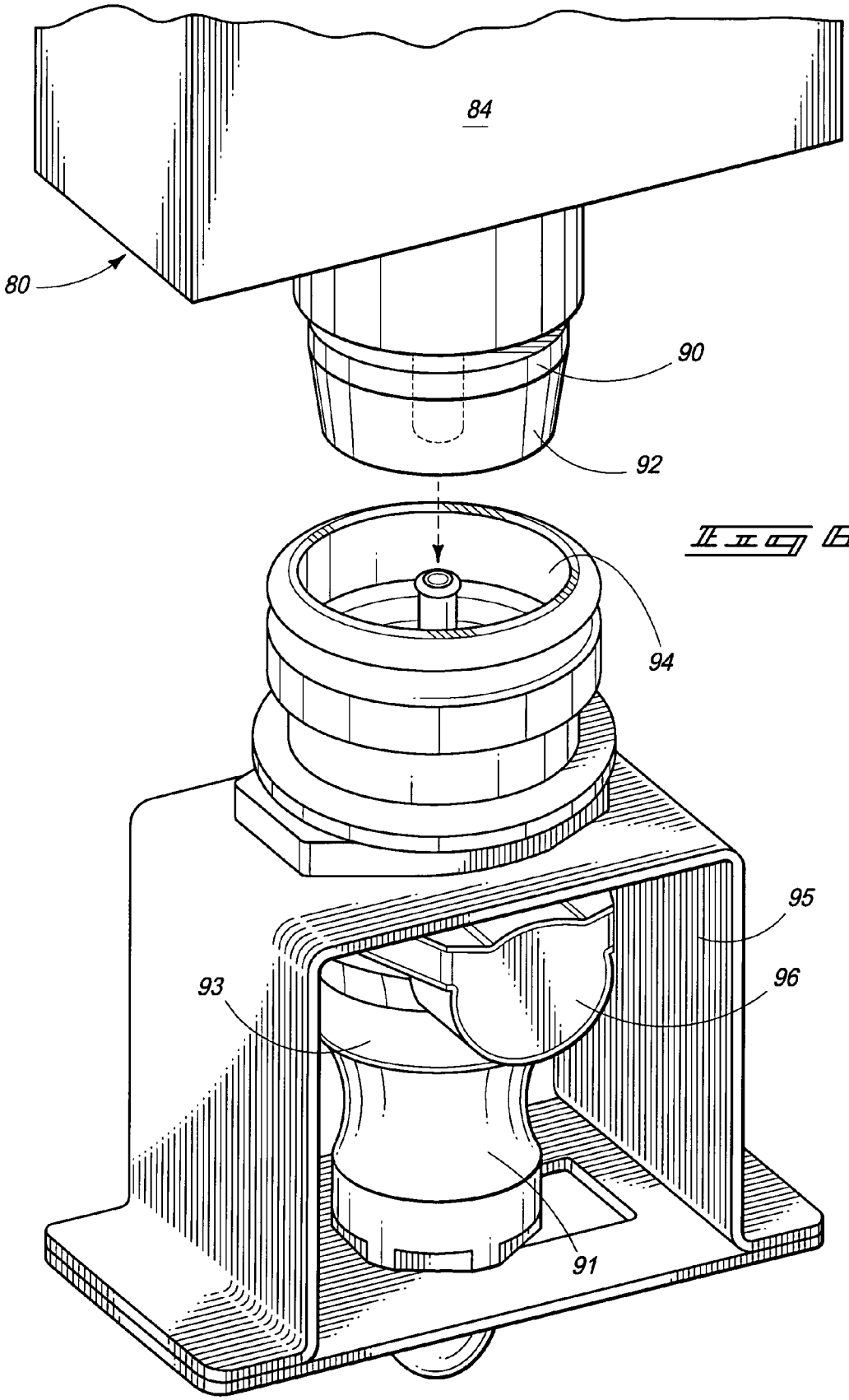
FIG. 6 is a perspective, fragmentary, exploded view of a valve arrangement which finds usefulness in the practice of the present invention.

A source of a liquid to be dispensed, and which will be supplied in the manner as described, hereinafter, to the refillable dispensing container 11 is generally indicated by the numeral 80 in FIG. 2, and following. The source of a liquid to be dispensed 80 may include water, or any number of different liquids including solutions for assorted industrial applications. The source of the liquid to be dispensed 80 will typically be provided in a disposable container generally indicated by the numeral 81 (bag-in-a-box), and which is disposed in gravity feeding relation, and supported in the cavity 33 as defined in the first end 31 of the housing 30. This is best seen by reference to FIG. 1. The container enclosing the source of the liquid to be dispensed may be manufactured from any number of different materials including paperboard, plastic or other recyclable materials. The container has a first end 82, and a second end 83. The container encloses a flexible bladder 84 which encloses the source of the liquid to be dispensed 80. The flexible bladder terminates in a male disposable dispensing coupler which is generally indicated by the numeral 90 (FIG. 6), and which is well understood in the art. The male disposable dispensing coupler 90 is operable to be received within a female dispensing coupler receiver 91 which is mounted within the cavity 33, and which is located at the first end 31 of the housing 30. When received within the female dispensing coupler 91, and secured therein, the source of liquid to be dispensed 80 can be received, and otherwise supplied from the female dispensing coupler receiver 91, and into a supply tank which will be discussed in greater detail hereinafter. The female dispensing coupler receiver 91 is operable to matingly couple with, and receive the distal end 92 of the male disposable coupler 90. Still further, the female dispensing coupler receiver 91 has a main body 93 which defines a cavity 94 for receiving the male disposable dispensing coupler 90. Still further, a frame member 95 is formed to support the female dispensing coupler receiver 91 in a fixed location on the housing 30 in the form of the invention as seen in FIG. 1. In an alternative form of the invention (FIG. 8), the female dispensing coupler could be attached to a short conduit (not shown) which will permit an operator to easily attach the female dispensing coupler to the male coupler when the disposable container 81 is inserted into the cavity 33A. Still further, as best seen by reference to FIG. 6, and in both forms of the invention as seen in FIGS. 1 and 8, the female dispensing coupler receiver 91 includes a release button 96 which allows for the decoupling of the male disposable dispensing coupler from the female counterpart 91 thereof so that a depleted container 81 may be removed from the housing 30 and 30A, and replaced with a new container 81. The release button mechanically cooperates with the release button 42, as earlier described in the first form of the invention as seen in FIG. 1. In the second form of the invention as seen in FIG. 8, an operator would open the door 42A, depress the release button 96, and lift and remove the disposable container 81 (bag-in-a-box) from the cavity 33A.

Figure 5:
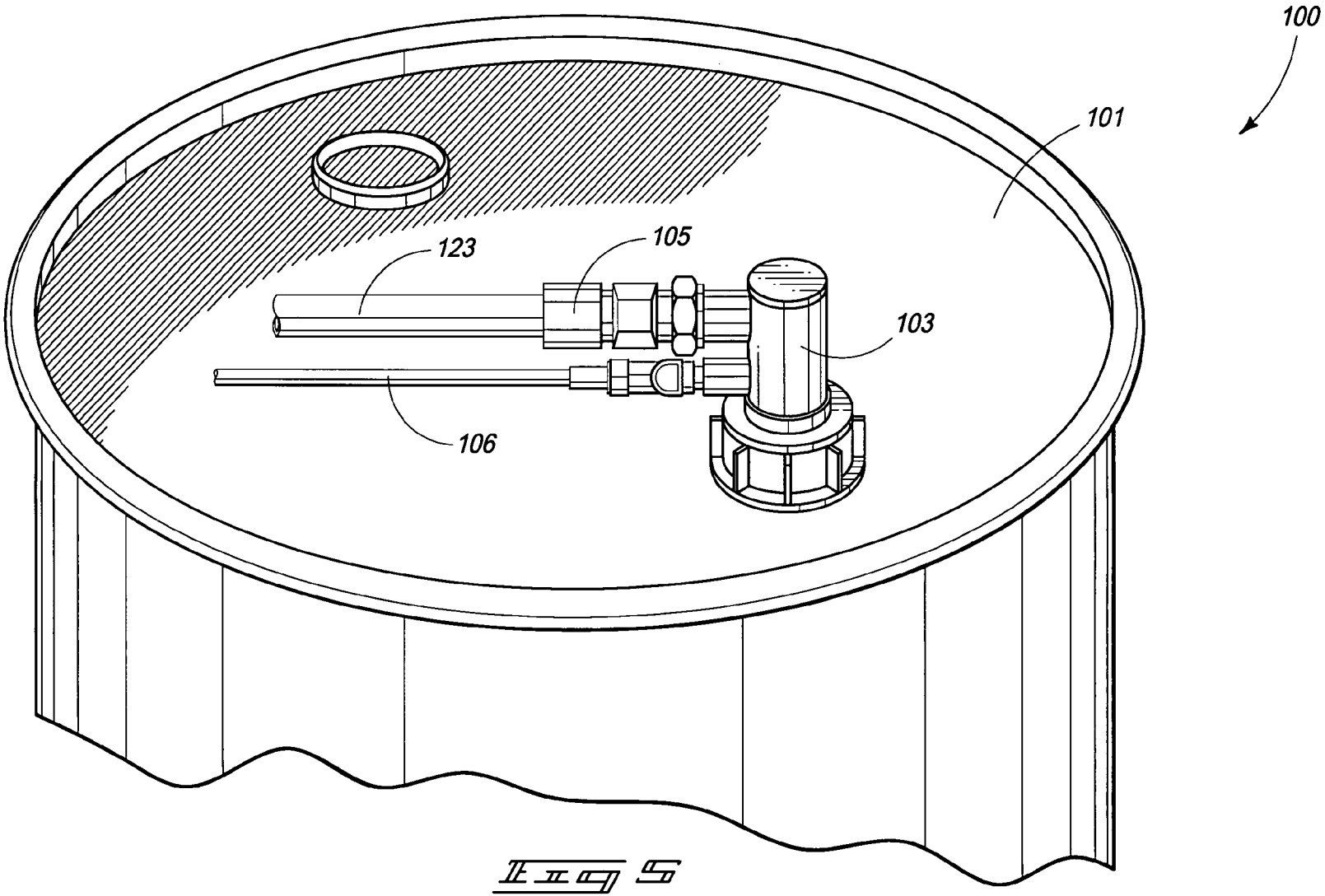
FIG. 5 is a perspective, partial, side elevation view of a pressurized sealed storage container which is a feature of one form of the present invention.

Referring now to FIG. 3, in an alternative form of the invention, a supply of a source of the liquid to be dispensed is provided from a sealed storage container 100 which stores the same source of liquid. As will be seen from a study of FIG. 3, the supply of the liquid to be dispensed in this arrangement is provided, by means of the pressurized propellant 60, to a supply tank which will be discussed in greater detail, hereinafter. The sealed storage container 100 may constitute a pail; bucket; 50 gallon drum; or other similar rigid, and sealed container which is suitable for storing the source of liquid to be dispensed 80. The sealed storage container 100 has a first, or top end 101, and a second, or bottom end 102 which rests on a supporting surface. Still further, a fluid dispensing valve 103 of conventional design (FIG. 5) is threadably secured to the first end 101. The dispensing valve has a fluid intake end 104, and a fluid exhaust end 105 (FIG. 3 and FIG. 5). Still further, the dispensing valve 103 has an air pressure intake port 106 which is coupled in fluid flowing relation relative to the fourth exhaust port 74 of the manifold 70, by way of a conduit, which will be described in greater detail hereinafter. Still further, a supply tube 107 is coupled to the fluid intake end 104 of the valve (FIG. 3), and is located within the sealed storage container 100, and is operable to transport the source of liquid to be dispensed 80 from the first intake end 104, thereof.

Referring now to FIG. 2, and following, the refilling apparatus 10 of the present invention includes a supply tank 110 which is mounted within the housing 30, and which contains a portion of the source of the liquid 80 to be dispensed, and which is located upstream of, and in gravity feeding relation relative to, a pressurized vessel which will be discussed in greater detail hereinafter. In the first form of the invention, the source of the liquid 80 is supplied to the storage tank from the disposable container 81. In the second form of the invention, the liquid to be dispensed is supplied from the sealed storage container 100 as seen in FIG. 3. More specifically, the supply tank 110 for receiving the source of a liquid to be dispensed 80 is positioned in downstream fluid flowing relation relative to the source of the liquid to be supplied. Further, the supply tank has a removable cover 111, and which has affixed thereto a vent or vent/muffler combination 112 which allows the internal cavity 113 of the supply tank 110 to be kept at substantially ambient air pressure. In an alternative form of the invention, not shown, this same vent or muffler could be mounted on the sidewall of the supply tank 110, and not on the cover 111, as illustrated. The cavity 113 has a given volume, and receives and holds a portion of the source of the liquid to be dispensed 80. Still further, in the first form of the invention (FIG. 1), a transparent window 114 is formed in the supply tank 110 so that an operator, by looking through the window 114 formed in the front wall 35 may determine the amount of liquid which is contained within the supply tank 110. In the second form of the invention as seen in FIG. 8, an operator, by looking at the portion of the transparent conduit 41A, which lies exposed, may determine the liquid level of the storage tank 110. Still further, as seen in FIG. 2, and following, a float valve 115, of conventional design, is mounted on the supply tank 110. The float valve includes a float member 120 which is supported on the surface of the source of the liquid to be dispensed 80, and which is received in the supply tank 110. The float member is connected to an arm 121 which is itself attached to the float valve 115. Those skilled in the art understand that when the level of the liquid to be dispensed moves to a low enough level within the supply tank, the arm member will move to a position which causes the float valve 115 to open and thereby permit the liquid from either the container 81, or the sealed storage container 100 as earlier described to enter the tank. This float valve 115 maintains a particular liquid level 116 in the supply tank. As seen in FIG. 3, a liquid supply tube which is generally indicated by the numeral 123 has a first end 124, which is coupled in fluid flowing relation relative to the fluid exhaust end of the valve 105, and which is mounted on the sealed storage container 100; and an opposite second end 125, which is coupled in fluid flowing relation relative to the float valve 115. Still further, as seen in FIGS. 2 and 3, it will be understood that an air pressure release muffler 126 is mounted within the cavity 113 as defined by the supply tank 110. The function of the air pressure release muffler will be discussed in greater detail, hereinafter. The supply tank 110 is coupled in gravity feeding, fluid flowing relation relative to a pressurized vessel as will be discussed, below, by means of a liquid supply conduit 130 which is coupled in fluid flowing relation relative to the supply tank 110. The liquid supply conduit has a first end 131, which is coupled in fluid flowing relation relative to the supply tank 110, and an opposite second end 132. Still further, mounted in a location intermediate the first and second ends 131 and 132 is a one-way fluid check valve 133 of conventional design, and which allows the supply tank 110 to supply a portion of the liquid to be dispensed 80, and which is stored in the supply tank 110 from the supply tank 110 to a pressurized vessel which is generally indicated by the numeral 140. In one form of the invention, the check valve may be secured directly to the supply tank 110 and then secured directly in fluid flowing relation to the pressurized vessel 140 thereby eliminating the conduit 130. The pressurized vessel 140 has a top surface 141, and a bottom surface 142. The pressurized vessel further defines an internal cavity 143 having a predetermined volume which is less than the predetermined volume of the refillable dispensing container 11 which was described above. A liquid intake port 144 is formed in the top surface, and is operable to be coupled in fluid flowing relation relative to the second end 132 of the liquid supply conduit 130. Still further, the pressurized vessel 140 has a liquid exhaust port 145 which is formed in the bottom surface 142 thereof. The liquid exhaust port 145 is coupled in fluid flowing relation relative to the first refilling station 51, and more specifically to the second portion of the filling valve 53 which is located within the first refilling station. Still further, a pressurized propellant intake port 146 is formed in the first surface 141 of the pressurized vessel, and is operable to receive pressurized propellant which is supplied to the pressurized vessel 140 from a three-way valve which will be discussed in greater detail in the paragraphs which follow.

Figure 7:
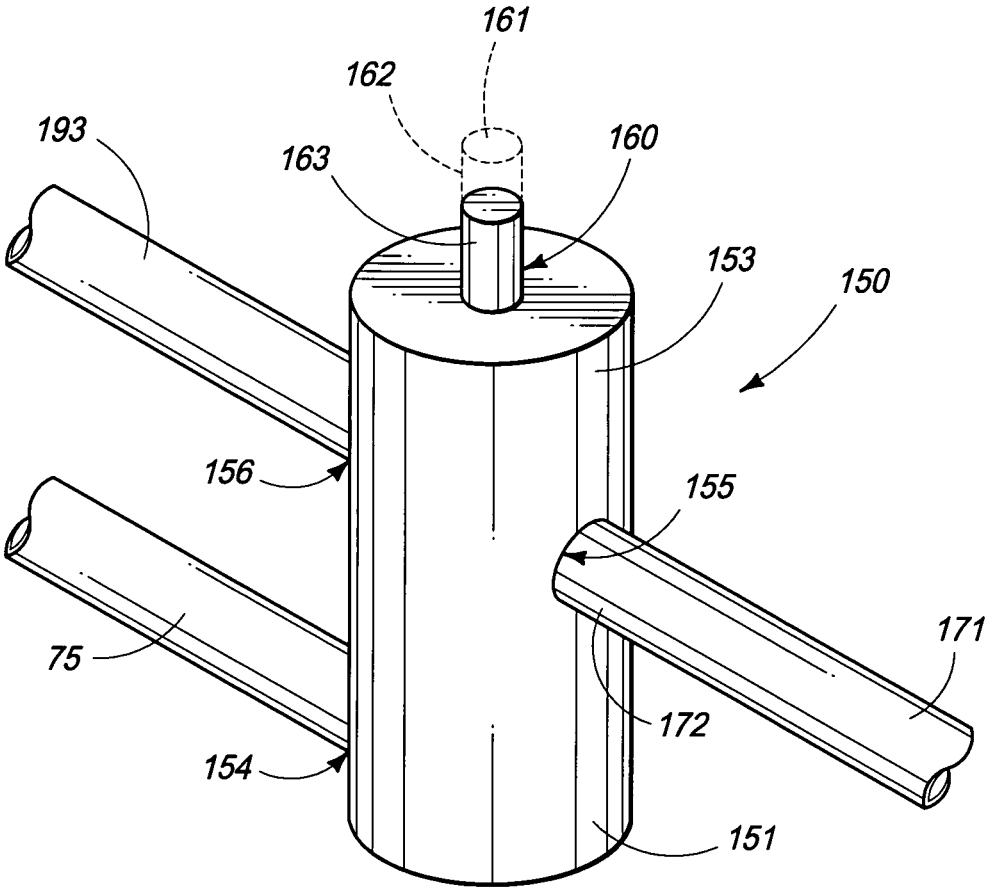
FIG. 7 is a greatly simplified, and fragmentary view of a three-way valve which finds usefulness in the present invention.

The refilling apparatus for a refillable container 10 of the present invention includes a three-way valve 150 which is coupled in fluid flowing relation relative to the pressurized propellant 60 which is supplied from the manifold 70 to the three-way valve 150 by way of the first propellant supply tube 75. Depending on the form of the invention utilized, there may be a first three-way valve 151, as seen in FIG. 2; or a second three-way valve 152 as seen in FIG. 3. Notwithstanding the form of the invention selected, the three-way valve 150 (FIG. 7) has a main body 153 which defines a first pressurized propellant intake port 154, and which is coupled in fluid receiving relation relative to the pressurized propellant supply tube 75. Still further, the three-way valve has a second exhaust port 155, and a third exhaust port 156. Still further, the main body 153 encloses a biased actuator 160 having a distal end 161, and which is operable to be engaged by the bottom end 14 of the refillable dispensing container 11 when the refillable dispensing container 11 is received within the first refilling station 51. As should be understood from the drawings as seen in FIGS. 2 and 3, the respective three-way valves 150 are not shown or illustrated being positioned in the first refilling station 51 for purposes of clarity. However, it will be appreciated that the distal end 161 of the biased actuator 160 will be positioned so that the bottom surface of the refillable dispensing container 11 can engage same when it is placed in the first refilling station 51 (See FIG. 1). The movement of the biased actuator by the engagement of the biased actuator with the bottom surface of the refillable dispenser container 11 causes each of the three-way valves 150 to be placed in one of two operational conditions or positions. In a first operational condition, which is generally indicated by the numeral 162, the biased actuator 160 assumes a position whereby no pressurized propellant 60 may pass through the main body 153 from the manifold 70, and further permits propellant pressure to be supplied from the three-way valve 150 to the air pressure release muffler 126 which is mounted within the supply tank 110 as will be described in greater detail, hereinafter.

Still further, the first three-way valve 150, when placed in a second operational condition or position 163, the biased actuator, and more specifically, the distal end 161 thereof is forcibly engaged by the bottom end 14, of the refillable dispensing container 11, and once depressed, the three-way valve 150 is operable to allow pressurized propellant 60 which is delivered by the manifold 70 by means of the pressurized propellant supply tube 75, to enter the three-way valve 150, and thereafter, be supplied by a first conduit 171 to the pressurized vessel 140. In this regard, the first conduit 171 has a first end 172 which is coupled in fluid flowing relation relative to the second exhaust port 155, and an opposite, second end 173, which is coupled in fluid flowing relation relative to the pressurized propellant intake port 146 which is mounted on the pressurized vessel 140. As will be seen best by FIGS. 2 and 3, the first conduit 171, has an intermediate portion 174, which is located between its first and second ends and which is positioned at an elevationally higher location than the level of liquid 116 which is maintained in the supply tank 110. This feature of the invention is important to the operation of the present invention 10, and will be described in greater detail, hereinafter.

A second conduit 182 is provided and which couples the pressurized container or vessel 140 in fluid flowing relation relative to the first refilling station 51. In this regard, the second conduit 182 has a first end 183, which is coupled in fluid flowing relation relative to the liquid exhaust port 145, and which is located on the bottom surface 142 of the pressurized vessel 140. Still further, the second conduit 182 has a second end 184, which is coupled in fluid flowing relation relative to the first refilling station 51, and more specifically to the second portion of the filling valve 53 and which itself is operable to matingly couple with the first portion of the filling valve 24 which is mounted on the bottom surface of the refillable dispensing container 11. Further, as seen in FIGS. 2 and 3, it will be seen that a third conduit 193 couples the three-way valve 150 in fluid flowing relation relative to the air pressure release muffler 126 which is mounted internally of the supply tank 110. In this regard, the third conduit has a first end 194 which is coupled in fluid flowing relation relative to the third exhaust port 156 of the three-way valve 150 and an opposite second end 195 which is coupled in fluid flowing relation relative to the air pressure release muffler 126.

Referring now to FIG. 3, in an alternative form of the invention 10, it will be seen that the refilling apparatus 10 of the present invention includes, in this form of the invention, a pressurized propellant supply tube which is generally indicated by the numeral 210, and which couples the manifold 70, and more specifically the fourth exhaust port 74 thereof, with the sealed storage or bulk container storing the liquid to be dispensed and which is generally indicated by the numeral 100. In this regard, the pressurized propellant supply tube 210 has first, second, third and fourth portions 211, 212, 213 and 214, respectively. In this regard, the first portion 211 has a first end 220 which is connected to the exhaust port 74 on the manifold 70 and further has an opposite second or distal end 221 which is coupled in fluid flowing relation relative to the first pressurized propellant intake port 154 which is located on the second three-way valve 152. As should be understood, the second three-way valve 152 as seen in FIG. 3 is positioned within the first refilling station 51 so that the distal end 161 of the biased actuator 160 may be engaged by the bottom end 14 of a refillable dispensing container 11 which is being placed within the first refilling station 51. As previously indicated, the respective three-way valves are illustrated in displaced positions relative to the respective refilling stations 51 and 52 so as to aid in the understanding of the invention. Moreover, it should be understood that FIGS. 2 and 3 are not drawn to scale, but schematically, so as to aid in the clarity and understanding of the operation of the present invention 10. Still further, the second portion 212 of the pressurized propellant supply 210 has a first end 222 which is coupled in fluid flowing relation relative to the second exhaust port 155 of the second three-way valve 152. Still further, the second portion 212 has a second end 223 which is coupled in fluid flowing relation relative to an air regulator 224 of conventional design. The air regulator 224 is operable to receive the pressurized propellant 60 which is typically being delivered at a pressure of less than about 150 pounds per square inch, and is operable to step down or reduce the propellant pressure and thus deliver a propellant pressure of less than about 3 psi. Still further, the third portion 213 of the pressurized propellant supply tube 210 has a first end 225 which is coupled in fluid receiving relation relative to the air regulator 224, and is operable to receive the air regulators output of about 3 psi of pressurized propellant and deliver it to the second end 226 thereof. The second end 226 of the third portion 213 is coupled in fluid flowing relation relative to a one-way check valve 230 which allows the stepped-down propellant pressure to be delivered to the sealed storage container 100, but does not allow pressure from the sealed storage container 100 to go in the direction of the air regulator 224. This is indicated by the arrow showing the direction of movement of the reduced air pressure through the check valve 230. Still further, the fourth portion 214 of the pressurized propellant supply tube 210 has a first end 231 which is coupled to the check valve 230, and further has an opposite, second end 232 which is coupled in fluid flowing relation relative to the air pressure intake port 106 which is made integral with the dispensing valve 103, and which is further releasably affixed to the sealed storage container 100 for storing the liquid to be dispensed 80. As will be understood from a study of FIG. 3, the third exhaust port 156 of the second three-way valve 152 is open to the ambient and is operable to vent the reduced propellant pressure coming from the second end 226 of the third portion 213 when the refillable dispensing container 11 is removed from the first refilling station 51. As will be further seen by reference to FIG. 3, an air pressure release valve 233 is provided intermediate the opposite first and second ends 231 and 232 of the fourth portion 214. The air pressure release valve is operable to prevent pressure build-up in the sealed storage container 100. This air pressure relieve valve will typically become operable when a pressure in excess of 5 psi is realized inside the sealed storage container 100.

In the arrangement as seen in the drawings, it will be understood that the respective three-way valves 150, which each have a biased actuator 160, are each positioned in the first refilling station 51 and are normally biased into the first operational position or condition 162 which does not allow the delivery of the source of pressurized propellant 60 from the manifold 70 to the pressurized vessel 140 or to the sealed storage container 100. In this first operational position 162, the pressurized vessel 140 contains little or no pressurized propellant, and in such a state, the one-way check valve 133 allows the supply tank 110 to supply a portion of the source of the liquid to be dispensed 80 to the pressurized vessel 140. As such, and under the influence of gravity, the liquid to be dispensed 80 fills the pressurized vessel 140 completely and thereafter enters into the pressurized propellant intake port 146 and into the second end 173, of the first conduit 171. The liquid to be dispensed 80 then moves up the first conduit 171 to a point substantially equal to the level of the liquid 116 which is maintained in the supply tank 110 by the float valve 115. At this point, the flow of the liquid to be dispensed stops. Because the liquid to be dispensed 80 has been drained from the supply tank, the float member 120 moves downwardly, and thereafter actuates the float valve 115 so as to allow the liquid to be dispensed 80, and which is contained within the container 81 and which is further positioned in gravity feeding relation relative to the supply tank 110 or supplied under pressure from the container 100, to enter into the supply tank 110. As the source of liquid to be dispensed 80 is received in the supply tank 110, it fills the volume of the supply tank 110 to a level 116 whereby the float member 120 causes the float valve 115 to be turned off, thereby stopping the supply of the source of liquid to be dispensed 80 into the supply tank 110. In the arrangement as seen in FIGS. 2 and 3, it will be understood that when the refillable dispensing container 11 is urged into the first refilling station 51, the positioning of the refillable dispensing container 11 within the refilling station causes the first and second portions of the filling valve 24 and 53 to be releasably, fluidly coupled together. This action causes the first three-way valve 150/151 to be forcibly engaged so as to move the actuator 160 from a first operational position 162 to a second operational position 163 which causes the delivery of the source of the pressurized propellant 60 to the pressurized vessel 140 by way of the first conduit 171. The propellant 60, and liquid 80 to be dispensed is then delivered from the pressurized vessel 140 to the internal volume 20 of the refillable dispensing container 11 by way of the second conduit 182. Again, upon removal of the refillable dispensing container 11 from the first filling station 51, the three-way valve 151 and more specifically the actuator 160 moves from the second operational position 163, to the first operational position, wherein the excessive pressurized propellant 60 passes through the three-way valve 151, and is received in the supply tank 110, and returned to the ambient environment. Following removal of the refillable dispensing container 11, the check valve 133 permits the flow of the liquid to be dispensed 80 from the supply tank 110 and into the pressurized vessel 140. As earlier discussed, the liquid flowing from the supply tank 110 fills the pressurized vessel 140, and flows into the first conduit 171 to a level which is substantially equal to the height of the liquid level 116 which is maintained by the float valve 115 within the supply tank 110. It is important to understand that the total volume of liquid contained within the pressurized vessel 140, and within the first conduit 171 up to the level of the fluid which is maintained in the supply tank 110, is less than the volume of the internal cavity 20 of the refillable dispensing container 11. In this manner, enough volume is left in the refillable dispensing container 11 so as to receive an effective volume of pressurized propellant thereby rendering the refillable dispensing container 11 operable to dispense the liquid to be dispensed from the refillable dispensing container 11 once it is removed from the first refilling station 51. When employing the refillable dispensing container 11, it should be understood that, on occasion, based upon the use of the container, the volume of propellant contained within the refillable dispensing container 11 may be depleted. In that situation, valuable dispensing fluid remains but there is no propellant to move the liquid out of the refillable dispensing container 11. In that event, an operator may thereafter place the refillable dispensing container 11 into the second refilling station 52 which is coupled in fluid flowing relation relative to the manifold 70 and replenish the propellant to the internal cavity 20 so as to ensure that all the liquid enclosed within the internal cavity 20 of the refillable dispensing container 11 can be effectively dispensed.

Simultaneously, as the refillable container 11 is moved or pressed into the refilling station 51, the second three way valve 152 is forcibly engaged. Referring to FIG. 3, it will be understood that when this occurs, and in this form of the invention, the engagement of the second three way valve 152 causes a release of the pressurized propellant 60 to the air regulator 224 by means of the conduit 212. Typically, this pressurized propellant has a pressure of less than about 150 psi. The air regulator upon receiving the pressurized propellant steps down or reduces the propellant pressure of 150 psi to a pressure of less than about 3 psi and supplies the reduced pressure propellant by way of the check valve 230 to the sealed storage container 100. This reduced pressure propellant is operable to facilitate movement of the liquid to be dispensed which is stored or contained in the sealed container 100 to move to the supply tank 110 by means of the conduit 123. When liquid has been dispensed from the supply tank 110, the float valve 115, when positioned appropriately, releases the fluid sent by the sealed storage container 100 into the storage tank 110 by way of the float valve 115. Once an appropriate amount has been received, the float 120 causes the float valve 115 to stop delivery of the liquid to be dispensed from the sealed storage container 100.

OPERATION

The operation of the described embodiments of the present invention including its methodology is believed to be readily apparent and is briefly summarized at this point.

In its broadest aspect, the present invention relates to a refilling apparatus 10 for a refillable container 11, and which receives, and then dispenses, a liquid 80 by means of a pressurized propellant 60 which is delivered to, and enclosed within, the refillable dispensing container 11. In its broadest aspect, a source of pressurized propellant 60 is provided and delivered to the refillable dispensing container 11. Still further, a valve 150 is coupled in fluid flowing relation relative to the source of pressurized propellant 60 and which further when engaged by the refillable dispensing container 11 facilitates the delivery of the source of pressurized propellant 60. Still further, the invention includes a source of a liquid to be dispensed 80 by the refillable container 11, and which is coupled in fluid flowing relation relative the valve 150. The valve 150 further facilitates the delivery of the source of the liquid 80 and the propellant 60 into the refillable dispensing container 11. Still further in its broadest aspect, the present invention includes a pressurized vessel 140 which is positioned in downstream fluid flowing relation relative to both the sources of the liquid to be dispensed 80, and the pressurized propellant 60, as well as the valve 150, and which further encloses a volume of the liquid 80 to be dispensed, and the propellant, to refill a depleted refillable dispensing container 11 when the refillable dispensing container forcibly engages the valve 150.

In another aspect of the present invention, a refilling apparatus for a refillable container 11 is provided and which includes a refillable container 11 having a main body 12 with a dispensing end 13 and an opposite bottom surface 14, and which further defines an internal cavity 20 having a given volume. In this form of the invention, a first portion of a filling valve 24 is mounted on the bottom surface 14 of the refillable container 11. Still further, the invention includes a dispensing valve 21 mounted on the dispensing end 13 of the refillable container 11; and a first filling station 51 is provided for matingly receiving the bottom surface 14 of the refillable container 11, and wherein a second portion of a filling valve 53 is mounted in the first filling station 51, and is configured to matingly fluidly couple with the first portion 24 of the filling valve which is mounted on the refillable container 11. In the present invention, a source of a pressurized propellant 60 for selective delivery to the internal cavity 20 of the refillable container 11 is provided. Still further, a source of a liquid 80 to be dispensed by the refillable container 11 is provided, and which is delivered to the internal cavity 20 of the refillable container 11. The sources of pressurized propellant 60 and the liquid to be dispensed 80 are delivered into the internal volume 20 of the refillable container 11 when the first and second portions of the filling valves 24 and 53 are coupled together in fluid flowing, relation. In this form of the invention, a supply tank 110 for receiving the source of the liquid to be dispensed 80 is provided; and further a float valve 115 is mounted within the supply tank 110, and which is coupled in fluid flowing relation relative to the source of the liquid to be dispensed 80. The float valve 115 selectively delivers the liquid to be dispensed 80 into the supply tank 110 so as to maintain the liquid to be dispensed 80 at a given liquid level 116. A one-way check valve 133 is mounted in downstream fluid flowing relation relative to the supply tank 110 and which facilitates the gravitational flow of the liquid to be dispensed 80 out of the supply tank 110. A pressurized vessel 140 having a given internal volume and which is positioned in downstream gravity receiving fluid flowing relation relative to the check valve 133 is provided. The internal volume of the pressurized vessel 140 is less than the internal volume of the refillable container 11. In the present invention, a manifold 70 is provided and coupled to the source of the pressurized propellant 60. Still further, a three-way valve 150 is provided and coupled in fluid flowing relation relative to the manifold 70 and to each of the supply tank 110 and the pressurized vessel 140. The three-way valve 150 is operatively and forceably engaged by the refillable dispensing container 11 when it is positioned in the first refilling station 51 (FIG. 1). In the present invention, a second refilling station 52 is located near the first refilling station 51, and which has a second portion of a filling valve 53 which will releasably couple with the first portion of the refilling valve 24 which is mounted on the bottom end 14 of the refillable dispensing container 11. The second refilling station 52 is coupled in fluid flowing relation relative to the manifold 70 so as to supply the source of pressurized propellant 60 to the refillable dispensing container when it is located in the second refilling station 52.

In the invention 10 which is described above, a first conduit 171 is provided, and which couples the three-way valve 150 in fluid flowing relation relative to the pressurized vessel 140. The first conduit 171 has an intermediate portion 174 which is located in an elevationally higher location than the liquid level 116 which is maintained in the supply tank 110 by the float valve 115. Still further, a second conduit 182 couples the pressurized vessel 140 in fluid flowing relation relative to the second portion of the filling valve 53 which is located in the first refilling station 51. In the arrangement as shown in the drawings, a third conduit 193 couples the three-way valve 150 with the supply tank 110. In the arrangement as seen, the positioning of the refillable dispensing container 11 within the first refilling station 51 causes the first and second portions of the filling valve 24 and 53 to be releasably coupled together, and the three-way valve is forcibly engaged so as to cause the three-way valve 151 to move from a first operational position 162, to a second operational position 163, respectively, and which causes the delivery of the source of the pressurized propellant 60 to the pressurized vessel 140 by way of the first conduit 171. This further causes the propellant 60 and liquid to be dispensed 80 to be delivered from the pressurized vessel 140 to the internal volume 20 of the refillable dispensing container 11 by way of the second conduit 182. In this arrangement, upon removal of the refillable dispensing container 11 from the first refilling station 51 the three-way valve moves back to the first operational position 162 wherein the excessive pressurized propellant passes through the three-way valve 150 and is received in the supply tank 110 and returned to the ambient environment. Still further, following removal of the refillable dispensing container 11 the check valve 133 permits the flow of the liquid to be dispensed 80 from the supply tank 110 and into the pressurized vessel 140. The liquid flowing from the supply tank fills the pressurized vessel 140 and then flows into the first conduit 171 to a level which is substantially equal to the height of the liquid level 116 which is maintained by the float valve 115 within the supply tank 110. As should be noted, the supply tank 110 provides a volume of liquid to be dispensed 80 which fills the pressurized vessel 140 and a portion of the first conduit up to the liquid level 116 maintained by the float valve 115 within the supply tank 110. These combined volumes of the pressurized vessel 140, and liquid in the first conduit 171 is less than the volume of the refillable container 11. The supply tank is operable to hold a volume of liquid to be dispensed equal to or greater than the amount necessary to fill three empty refillable containers 11.

The present invention also relates to a method for refilling a refillable dispensing container 11 which includes, in its broadest aspect, the steps of providing a refillable dispensing container 11 having an internal volume 20; and providing a refilling station 51 that releasably fluidly couples with the refillable dispensing container 11. In this methodology, the present invention further includes the steps of providing a source of a pressurized propellant 60, and coupling the source of the pressurized propellant to the refilling station 51. Still further, the method includes the step of providing a source of a liquid to be dispensed 80 by the refillable dispensing container 11, and coupling the source of the liquid to be dispensed 80 to the refilling station 51. In its broadest form of the invention, the method includes a step of delivering a predetermined amount of pressurized propellant 60, and a volume of liquid 80 to be dispensed to the refillable dispensing container 11, and which is less than the internal volume of the refillable container 11. In the present invention, the method further includes a step of providing a three-way valve 150 which is coupled in fluid flowing relation relative the source of the pressurized propellant 60, and the refilling station 51. In this methodology, the three-way valve 150 is oriented so as to be operably engaged by the refillable dispensing container 11 when the refillable dispensing container is located in the refilling station 51. In the present methodology, the method also includes another step of providing a supply tank 110 for receiving the source of the liquid to be dispensed 80, and coupling the supply tank 110 in fluid flowing relation relative to the three-way valve 150. Still further, the method includes an additional step of providing a pressurized vessel 140, and coupling the pressurized vessel 140 in selective, one-way, fluid flowing relation relative to the supply tank 110, and in fluid flowing relation relative to the three-way valve 150 and the refilling station 51. The method also includes another step of maintaining a given liquid level 116 of the source of liquid to be dispensed 80 within the supply tank 110. In the method as described herein, the invention further includes a step of providing a second refilling station 52 which is configured to releasably fluidly couple with the refillable dispensing container 11, and coupling the second refilling station 52 in fluid flowing relation relative to the source of the pressurized propellant 60. In the methodology as described, above, the method of the present invention further includes a step of providing a manifold 70 which is coupled in fluid flowing relation relative to the source of the pressurized propellant 60, and coupling the first and second refilling stations 51 and 52 in fluid flowing relation relative to the manifold 70.

In the method of the present invention, the present invention includes the step of providing a first conduit 171 which couples the three-way valve 150 in fluid flowing relation relative to pressurized vessel 140 so as to deliver the source of the pressurized propellant 60 to the pressurized vessel 140. The method further includes a step whereby the first conduit 171 has an intermediate portion 174 which is located in an elevationally higher location than the given liquid level 116 which is maintained within the supply tank 110. In this arrangement, the method includes another step of providing a second conduit 182 which couples the pressurized vessel 140 to the first refilling station 51; and providing a third conduit 193 which couples the three-way valve 150 with the supply tank 110.

In the method of the present invention, the method includes a further step of first, engaging the three-way valve 150 with the refillable dispensing container 11 when locating the refillable dispensing container in the first refilling station 51 so as to cause the delivery of the source of pressurized propellant 60 to the pressurized vessel 140 by way of the first conduit 171. Still further, the method includes another step of second, supplying a predetermined volume of the liquid to be dispensed 80 from the pressurized vessel 140, and the source of the propellant 60 from the three-way valve to the refilling station 51 by way of the second conduit 182. Thirdly, the methodology includes a step of filling the refillable dispensing container 11 with the volume of liquid to be dispensed 80 from the pressurized vessel 140 and the source of pressurized propellant 60. In this arrangement, the methodology includes another step of fourth, removing the refillable dispensing container 11 from the first refilling station 51 and from operable engagement with the three-way valve 150; and fifth, releasing propellant pressure from the pressurized vessel 140 to the supply tank 110 by way of the third conduit 193. In this methodology, the method includes another, sixth step, of supplying the source of liquid to be dispensed 80 from the supply tank 110 to the pressurized vessel 140, and wherein the volume of liquid to be dispensed 80 fills the entire pressurized vessel 140 and the first conduit 171 up to the liquid level 116 maintained in the supply tank 110. Still further, this method includes repeating steps one-six, outlined, above, again. In the methodology as described above, the step of maintaining the liquid level of the supply tank 110 further includes the step of providing a float valve 115, and coupling the float valve in fluid flowing relation relative to the source of the liquid to be dispensed 80.

Another aspect of the methodology of the present invention relates to a method for refilling a refillable container which includes the steps of providing a source of pressurized propellant 60; and providing a supply tank 110 which encloses a source of a liquid to be dispensed 80. This methodology includes another step of providing a refilling station 51; and providing a refillable dispensing container 11 which is configured to mating, fluidly couple with the refilling station 51. Still further, this methodology includes another step of providing a three-way valve 150 which has a first, and a second operational position 162 and 163, and locating the three-way valve 150 in the refilling station so that the three-way valve may be forcibly engaged so as to move from a first operational position 162, to a second operational position 163 when the refillable dispensing container 11 is located in the refilling station 51 and operably engages the three-way valve 150. This methodology further anticipates that the three-way valve 150 is coupled in fluid flowing relation relative to the source of pressurized propellant 60. In this arrangement, the three-way valve delivers the source of the propellant 60 to the refillable dispensing container 11 when the three-way valve is located in the second operational position 163. The method includes another step of providing a pressurized vessel 140 which is located in downstream liquid receiving relation relative to the supply tank 110, and coupling the pressurized vessel 140 in fluid flowing pressure receiving relation relative to the three-way valve 150. Still further, this methodology includes a step of selectively supplying the source of the liquid 80 to be dispensed from the supply tank 110 to the pressurized vessel 140 so as to fill the pressurized vessel 140 with the source of the liquid to be dispensed 80 when the three-way valve is located in the first operational position 162, and the refillable container 11 is removed from the refilling station 51. The method includes another step of coupling the supply tank 110 in fluid flowing relation relative to the three-way valve 150. Still further, the method includes another step of coupling the pressurized vessel 140 in fluid flowing communication with the refilling station 51; and supplying the source of the liquid to be dispensed 80 from the pressurized vessel 140, to the refilling station 51 with the pressurized propellant 60 when the three-way valve 150 is located in the second position 163. As should be understood, after the step of selectively supplying the source of the liquid to be dispensed 80, the method further includes a step of providing a check valve 133 which is positioned intermediate the supply tank 110, and the pressurized tank 140, and which facilitates the flow of liquid to be dispensed 80 only in the direction from the supply tank 110 to the pressurized vessel 140. Still further, in the methodology as described above, the step of providing a source of pressurized propellant 60 further includes a step of providing a manifold 70, and coupling the source of the pressurized propellant 60 to the manifold 70; and wherein the manifold 70 is coupled in fluid flowing relation relative to the three-way valve 150 so as to provide the source of the pressurized propellant 60 to the three-way valve 150. In the method as described above, the method of the present invention includes another step of providing a second refilling station 52 which is coupled in fluid flowing relation relative to the manifold 70, and wherein the refillable dispenser 11 is configured to matingly fluidly couple with the second refilling station 52 so as to be replenished with pressurized propellant 60. In the arrangement as seen in the drawings, the step of coupling the pressurized vessel 140 in fluid flowing relation relative the three-way valve 150 further includes the step of providing a first conduit 171 which couples the three-way valve 150, and the pressurized vessel 140, together, and wherein the first conduit 171 has an intermediate portion 174 which is located elevationally higher than the liquid level 116 which is maintained in the supply tank 110, and wherein the step of selectively supplying the source of the liquid to be dispensed 80 from the supply tank 110 further comprises filling a portion of the first conduit 171 with the liquid to be dispensed 80 to a level which is elevationally below the intermediate region 174 of the first conduit 171 and approximately equal to the liquid level 116 which is maintained within the supply tank 110. In the methodology as described above, the step of supplying the liquid to be dispensed 80 from the pressurized vessel 140 to the refilling station 51 with the pressurized propellant 60 further includes the step of providing a second conduit 182 which couples the pressurized vessel 140 with the refilling station 51. Still further, the step of coupling the supply tank 110 in fluid flowing relation relative to the three-way valve 150 further includes the step of providing a third conduit 193 which extends from the supply tank 110, to the three-way valve 150.

Therefore, it will be seen that the present apparatus, and method as described herein, provides a convenient means whereby a refillable dispensing container 11 and may be repeatedly, and selectively recharged with both a liquid to be dispensed, as well as a propellant, in a safe, and convenient fashion, and in a manner not possible, heretofore.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A refilling apparatus for a refillable container, comprising:

a refillable dispensing container for receiving, and then dispensing, a liquid by means of a pressurized propellant which is delivered to, and enclosed within, the refillable dispensing container;

a source of pressurized propellant for delivery to the refillable dispensing container;

a valve coupled in fluid flowing relation relative to the source of pressurized propellant and which further when engaged by the refillable dispensing container facilitates the delivery of the source of pressurized propellant;

a source of a liquid to be dispensed by the refillable container and which is coupled in fluid flowing relation relative the valve, and wherein the valve further facilitates the delivery of the source of the liquid and the propellant into the refillable dispensing container; and a pressurized vessel positioned in downstream fluid flowing relation relative to both the sources of the liquid to be dispensed, and the pressurized propellant, as well as the valve, and which further encloses a volume of the liquid to be dispensed, and the propellant, to refill a depleted refillable dispensing container when the refillable dispensing container engages the valve.

2. A refilling apparatus as claimed in claim 1, and wherein the valve is a three-way valve, and wherein the refilling apparatus further comprises a filling valve which is coupled in fluid flowing relation relative to the pressurized vessel and which is configured to releasably fluidly couple with the refillable dispensing container so as to facilitate the delivery of the liquid to be dispensed, and the pressurized propellant to the refillable dispensing container from the pressurized vessel.

3. A refilling apparatus as claimed in claim 2, and wherein the refillable dispensing container is defined by a sidewall, a top and bottom surface, and an internal cavity which is defined by the top and bottom surfaces and the sidewall, and wherein a valve is mounted on the bottom surface of the refillable container, and is configured to releasably, matingly cooperate with the filling valve so as to couple the refillable dispensing container in fluid flowing relation relative to the pressurized vessel, and a dispensing valve is mounted on the top surface of the refillable dispensing container, and which facilitates the release of the liquid to be dispensed from the internal cavity, and wherein the bottom surface of the refillable dispensing container operably engages the three-way valve when the refillable dispensing container is being refilled.

4. A refilling apparatus as claimed in claim 2, and wherein the three-way valve is located in a first refilling station, and wherein the refilling apparatus has a second refilling station which has a second filling valve which is coupled in fluid flowing relation relative to the source of pressurized propellant, and which is configured to releasably couple in fluid flowing relation relative to the refillable dispensing container when the refillable dispensing container is located in the second refilling station so as to replenish the refillable dispensing container with the source of pressurized propellant.

5. A refilling apparatus as claimed in claim 1, and further comprising:

a supply tank containing a portion of the source of the liquid to be dispensed, and which is located upstream of, and in gravity feeding relation relative to, the pressurized vessel; and a fluid check valve positioned in downstream fluid flowing relation relative to the supply tank, and in upstream fluid flowing relation relative to the pressurized vessel, and wherein the fluid check valve permits the flow of the source of liquid to be dispensed only from the supply tank to the pressurized vessel.

6. A refilling apparatus as claimed in claim 5, and further comprising:

a float valve mounted within the supply tank, and which is disposed in selective, fluid flowing relation relative to the supply tank, and which is further operable to meter the source of the liquid to be dispensed into the supply tank.

7. A refilling apparatus as claimed in claim 5, and wherein the source of the fluid to be dispensed is supplied to the float valve by means of a flexible bladder.

8. A refilling apparatus as claimed in claim 5, and wherein the source of the liquid to be dispensed is supplied to the float valve from a pressurized supply container.

9. A refilling apparatus as claimed in claim 4, and further comprising:

a supply tank containing a portion of the liquid to be dispensed, and which is located upstream of, and in gravity feeding relation relative to, the pressurized vessel, and wherein the supply tank maintains a predetermined liquid level for the source of liquid to be dispensed;

a first conduit coupled in fluid flowing relation therebetween the three-way valve, and the pressurized vessel, and which is operable to deliver the source of pressurized propellant to the pressurized vessel, and wherein the first conduit has an intermediate portion which is located in an elevationally higher position than the liquid level maintained by the supply tank;

a second conduit coupled in fluid flowing relation therebetween the pressurized vessel and the filling valve, and which is operable to deliver the liquid to be dispensed, and the source of pressurized propellant from the pressurized vessel to the refillable dispensing container when the refillable dispensing container is releasably fluidly coupled to the filling valve and further engages the three-way valve; and a third conduit coupled in fluid flowing relation therebetween the three-way valve and the supply tank.

10. A refilling apparatus as claimed in claim 9, and further comprising:

a manifold coupled in fluid receiving relation relative to the source of pressurized propellant, and which further has a first intake port coupled in fluid receiving relation relative to the source of the pressurized propellant, and second and third exhaust ports, and wherein the second exhaust port is coupled in fluid flowing relation relative to the three-way valve, and the third exhaust port is coupled in fluid flowing relation relative to the second filling valve which is located in the second refilling station.

11. A refilling apparatus as claimed in claim 10, and wherein the three-way valve has a first intake port, and second and third exhaust ports, and wherein the first exhaust port of the manifold is coupled in fluid flowing relation to the first intake port of the three-way valve; the second exhaust port of the three-way valve is coupled in fluid flowing relation relative to the pressurized vessel; and the third exhaust port of the three-way valve is coupled in fluid flowing relation relative to the ambient environment; and wherein the three-way valve has a first operational position where the three-way valve does not deliver the source of the pressurized propellant to the pressurized vessel; and a second operational position where the three-way valve delivers the source of the pressurized propellant to the refillable dispensing container.

12. A refilling apparatus as claimed in claim 1, and wherein both the refillable dispensing container and the pressurized vessel each has an internal volume, and wherein the internal volume of the refillable dispensing container is greater than the internal volume of the pressurized vessel.

13. A refilling apparatus as claimed in claim 1, and wherein the source of pressurized propellant is a source of compressed air which is delivered at a pressure of less than about 150 PSI.

14. A refilling apparatus for a refillable container, comprising:

a refillable container having a main body with a dispensing end and an opposite bottom surface, and which further defines an internal cavity having a given volume;

a first portion of a filling valve mounted on the bottom surface of the refillable container;

a dispensing valve mounted on the dispensing end of the refillable container;

a first filling station for matingly receiving the bottom surface of the refillable container, and wherein a second portion of a filling valve is mounted in the first filling station, and is configured to matingly couple with the first portion of the filling valve which is mounted on the refillable container;

a source of a pressurized propellant for selective delivery to the internal cavity of the refillable container;

a source of a liquid to be dispensed by the refillable container, and which is delivered to the internal cavity of the refillable container, and wherein the sources of pressurized propellant and the liquid to be dispensed are delivered into internal cavity of the refillable container when the first and second portions of the filling valves are coupled together in fluid flowing relation;

a supply tank for receiving the source of the liquid to be dispensed;

a float valve mounted within the supply tank, and which is coupled in fluid flowing relation relative to the source of the liquid to be dispensed, and wherein the float valve selectively delivers the liquid to be dispensed into the supply tank so as to maintain the liquid to be dispensed at a given liquid level;

a one-way check valve mounted in downstream fluid flowing relation relative to the supply tank and which facilitates the gravitational flow of the liquid to be dispensed out of the supply tank;

a pressurized vessel having a given internal volume and which is positioned in downstream gravity receiving fluid flowing relation relative to the check valve, and wherein the internal volume of the pressurized vessel is less than the internal volume of the refillable container;

a manifold coupled to the source of the pressurized propellant;

a three-way valve coupled in fluid flowing relation relative to the manifold and to each of the supply tank and the pressurized vessel, and wherein the three-way valve is operatively and forceably engaged by the refillable dispensing container when it is positioned in the first refilling station;

a second refilling station located near the first refilling station, and which has a second portion of a filling valve which will releasably couple with the first portion of the refilling valve which is mounted on the bottom of the refillable dispensing container, and wherein the second refilling station is coupled in fluid flowing relation relative to the manifold so as to supply the source of pressurized propellant to the refillable dispensing container when it is located in the second refilling station;

a first conduit coupling the three-way valve in fluid flowing relation relative to the pressurized vessel, and wherein the first conduit has an intermediate portion which is located in an elevationally higher location than the liquid level which is maintained in the supply tank by the float valve;

a second conduit coupling the pressurized vessel in fluid flowing relation relative to the second portion of the filling valve which is located in the first refilling station; and a third conduit coupling the three-way valve with the supply tank, and wherein the positioning of the refillable dispensing container within the first refilling station causes the first and second portions of the filling valve to be releasably coupled together, and the three-way valve to be forcibly engaged so as to cause the three-way valve to move from a first operational position to a second operational position which causes the delivery of the source of the pressurized propellant to the pressurized vessel by way of the first conduit, and the propellant and liquid to be dispensed is then delivered from the pressurized vessel to the internal volume of the refillable dispensing container by way of the second conduit; and wherein upon removal of the refillable dispensing container from the first refilling station the three-way valve moves to the first operational position wherein the excessive pressurized propellant passes through the three-way valve and is received in the supply tank and returned to the ambient environment, and wherein following removal of the refillable dispensing container the check valve permits the flow of the liquid to be dispensed from the supply tank and into the pressurized vessel, and wherein the liquid flowing from the supply tank fills the pressurized vessel and flows into the first conduit to a level which is substantially equal to the height of the liquid level which is maintained by the float valve within the supply tank.

15. A refilling apparatus as claimed in claim 14, and wherein the supply tank provides a volume of liquid to be dispensed which fills the pressurized vessel and a portion of the first conduit up to the liquid level maintained by the float valve within the supply tank which is less than the volume of the refillable container.

16. A refilling apparatus as claimed in claim 15, and wherein the source of the pressurized propellant is a source of compressed air which is delivered at a pressure of less than about 150 PSI.

17. A refilling apparatus as claimed in claim 14, and further comprising:

a vessel for storing the source of the liquid to be dispensed, and which is coupled in liquid delivering relation relative to the float valve located within the supply tank; and a conduit coupling the vessel in fluid flowing relation relative to the manifold, and which facilitates the delivery of at least a portion of the source of the pressurized propellant to the vessel so as to cause the delivery of the liquid to be dispensed from the vessel to the float valve.

18. A refilling apparatus as claimed in claim 14, and wherein the refillable container is releasably locked to the refilling apparatus when the refillable container is located in the first and second refilling stations.

19. A refilling apparatus for a refillable container, comprising:

a refillable dispensing container for receiving and then dispensing a liquid by means of a pressurized propellant which is delivered to and enclosed within the refillable dispensing container;

a source of pressurized propellant for delivery to the refillable dispensing container;

a first valve coupled in fluid flowing relation relative to the source of pressurized propellant and which further, when engaged by the refillable dispensing container, facilitates the delivery of the source of pressurized propellant;

a supply tank containing a source of a liquid to be dispensed by the refillable dispensing container and which is coupled in gravity feeding, fluid flowing relation relative to the first valve, and wherein the first valve facilitates the delivery of the source of the liquid to be dispensed, and the propellant into the refillable dispensing container;

a supply of the source of liquid to be dispensed and which is enclosed within a sealed storage container, and which is coupled in fluid flowing relation relative to the supply tank;

a second valve coupled in fluid flowing relation relative to the source of pressurized propellant and with the sealed storage container, and which further, when engaged by the refillable dispensing container facilitates the delivery of the source of pressurized propellant to the sealed storage container enclosing the supply of the liquid to be dispensed so as to facilitate the movement of the liquid enclosed in the sealed storage container to the supply tank; and a pressurized vessel positioned in downstream fluid flowing relation relative to the supply tank to receive the source of fluid to be dispensed and the pressurized propellant as delivered by the first valve, and which further encloses a volume to the liquid to be dispensed and the propellant, to refill a depleted refillable dispensing container when the first refillable dispensing container engages both the first and second valves.

20. A refilling apparatus as claimed in claim 19, and wherein the first and second valves are three-way valves.

21. A refilling apparatus as claimed in claim 19, and further comprising:

an air pressure regulator located downstream of the second valve, and upstream of the sealed storage container, and which reduces the pressure of the source of pressurized propellant to less than about 3 psi.

22. A refilling apparatus as claimed in claim 19, and further comprising:

a one-way check valve located downstream of the second valve, and upstream of the sealed storage container, and which is configured to allow the source of pressurized propellant to move only in the direction from the second valve to the sealed storage container.

23. A refilling apparatus as claimed in claim 19, and further comprising:

a pressure relief valve located upstream of the sealed storage container, and downstream of the second valve.

* * * * *